US009150393B2

(12) United States Patent
Yang

(10) Patent No.: US 9,150,393 B2
(45) Date of Patent: Oct. 6, 2015

(54) THIN JACK

(71) Applicant: Chung-Yi Yang, New Taipei (TW)

(72) Inventor: Chung-Yi Yang, New Taipei (TW)

( * ) Notice: Subject to any disclaimer, the term of this patent is extended or adjusted under 35 U.S.C. 154(b) by 143 days.

(21) Appl. No.: 14/094,627

(22) Filed: Dec. 2, 2013

(65) Prior Publication Data

US 2015/0151955 A1 Jun. 4, 2015

(51) Int. Cl.
*B66F 3/26* (2006.01)

(52) U.S. Cl.
CPC ..... *B66F 3/26* (2013.01)

(58) Field of Classification Search
CPC ..... B25B 1/02; B25B 1/106; B25B 1/20; B66F 3/26; B66F 3/36
USPC ..... 269/43, 32, 24–27, 291; 254/93 R
See application file for complete search history.

(56) References Cited

U.S. PATENT DOCUMENTS 4,934,672 A * 6/1990 Craft ..... 269/22
8,132,801 B2 * 3/2012 Miyashita et al. ..... 269/49

* cited by examiner

*Primary Examiner* — Monica Carter
*Assistant Examiner* — Nirvana Deonauth
(74) *Attorney, Agent, or Firm* — WPAT, P.C.; Anthony King

(57) ABSTRACT

A thin jack includes a body, a piston support post, and a dividing piston. The body has a receiving chamber which opens down, a limiting piston circumferentially disposed on the receiving chamber, and upper and lower passages penetrating the body and being in communication with the receiving chamber. The piston support post is movably received in the receiving chamber and is in fluidtight sliding contact with the limiting piston. The dividing piston is disposed at the piston support post, is in fluidtight sliding contact with the receiving chamber, corresponds in position to the limiting piston to confine the dividing piston to the receiving chamber, and divides the receiving chamber into upper and lower receiving spaces in communication with the upper and lower passages, respectively. Accordingly, elevation of the body is controllable while lifting an object, and users can keep raising the thin jack without moving the thin jack horizontally.

2 Claims, 23 Drawing Sheets

6

7

THIN JACK

FIELD OF THE INVENTION

The present invention relates to jacks, and more particularly, to a thin jack which is not only capable of controlling elevation of a body of the thin jack while lifting an object, but also allow users to keep raising the thin jack without moving the thin jack horizontally.

BACKGROUND OF THE INVENTION

To lift an object which otherwise rests on the ground and is spaced apart therefrom by a narrow gap, a thin jack is required. Referring to FIG. 1 through FIG. 3, there are shown schematic views of a conventional thin jack 1. The thin jack 1 consists of a hydraulic hole 2, a hydraulic chamber 3, and a support post 4. Oil is introduced into the hydraulic chamber 3 through the hydraulic hole 2 to elevate the support post 4, thereby lifting an object 1000.

Referring to FIG. 3, after lifting the object 1000, users put at least a support 5 in the vicinity of the thin jack 1 to support the object 1000, drain the oil from the hydraulic chamber 3 to lower the support post 4 back to its initial level shown in FIG. 1, and eventually remove the thin jack 1 from below the object 1000.

As indicated above, the support post 4 will not descend to thereby allow the thin jack 1 to be removed from below the object 1000, unless the oil is drained from the hydraulic chamber 3. However, it takes time to drain the oil from the hydraulic chamber 3.

In addition, the thin jack 1 is not capable of lifting the object 1000 by a distance larger than the longest possible distance traveled by the support post 4 of the thin jack 1.

Furthermore, to raise the thin jack by means of a plurality of underpinning block (not shown) with a view to solving the problem described in the preceding paragraph, the users have to move the thin jack 1 repeatedly. However, conventional thin jacks are not lightweight enough to be moved repeatedly but easily by average users.

Accordingly, it is imperative to provide a thin jack which is not only capable of controlling elevation of a support post of the thin jack while lifting an object, but also allow users to raise the thin jack continuously and easily without moving the thin jack horizontally.

SUMMARY OF THE INVENTION

In view of the aforesaid drawbacks of the prior art, it is an objective of the present invention to provide a thin jack capable of controlling elevation of a body of the thin jack while lifting an object, so as to allow users to remove the thin jack from below the object easily.

Another objective of the present invention is to provide a thin jack capable of being raised continuously without being moved horizontally by the users.

In order to achieve the above and other objectives, the present invention provides a thin jack which comprises a body, a piston support post, and a dividing piston.

The body has: a receiving chamber concavely disposed in the body and having an opening opening down; a limiting piston circumferentially disposed on a sidewall of the receiving chamber and positioned proximate to the opening; an upper passage penetrating a sidewall of the body and being in communication with a top portion of the receiving chamber; and a lower passage penetrating the sidewall of the body and being in communication with a bottom portion of the receiving chamber.

The piston support post is movably received in the receiving chamber and has a sidewall in fluidtight sliding contact with the limiting piston.

The dividing piston is disposed at a top portion of the piston support post, is in fluidtight sliding contact with a sidewall of the receiving chamber, and corresponds in position to the limiting piston to confine the dividing piston to the receiving chamber. The dividing piston divides the receiving chamber into an upper receiving space and a lower receiving space. The upper receiving space is in communication with the upper passage. The lower receiving space is in communication with the lower passage.

The thin jack further comprises a supporting annular unit with an internal thread structure disposed on an inner wall of the supporting annular unit, and the body further has an external thread structure disposed on an outer surface of a sidewall of the body, the external thread structure corresponding in position to the internal thread structure, such that the body can be fixed in place by the supporting annular unit.

As regards the thin jack, an outward opening of the upper passage of the body is positioned above the external thread structure, and an outward opening of the lower passage of the body is positioned above the external thread structure.

As regards the thin jack, the body further has a jack platform disposed at a top portion of the body.

In conclusion, given the aforesaid constituent elements of a thin jack of the present invention, a body of the thin jack is put under control to meet users' needs while an object is being lifted by the thin jack, so that it is easy for the users to remove the thin jack from below the object. Furthermore, the users can keep raising the thin jack without moving the thin jack horizontally.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE PREFERRED EMBODIMENTS

Figure 1:
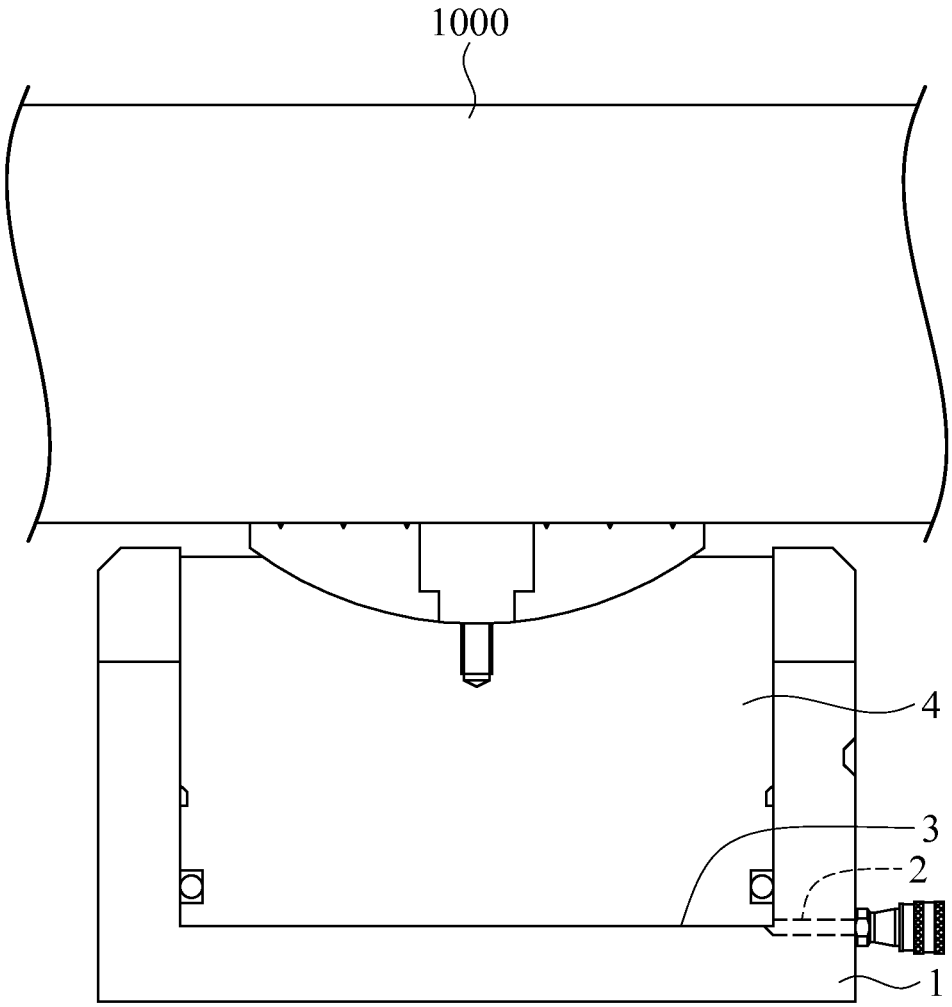
FIG. 1 (PRIOR ART)
FIG. 1 through FIG. 3 (PRIOR ART) are schematic views of a conventional thin jack.
Figure 2:
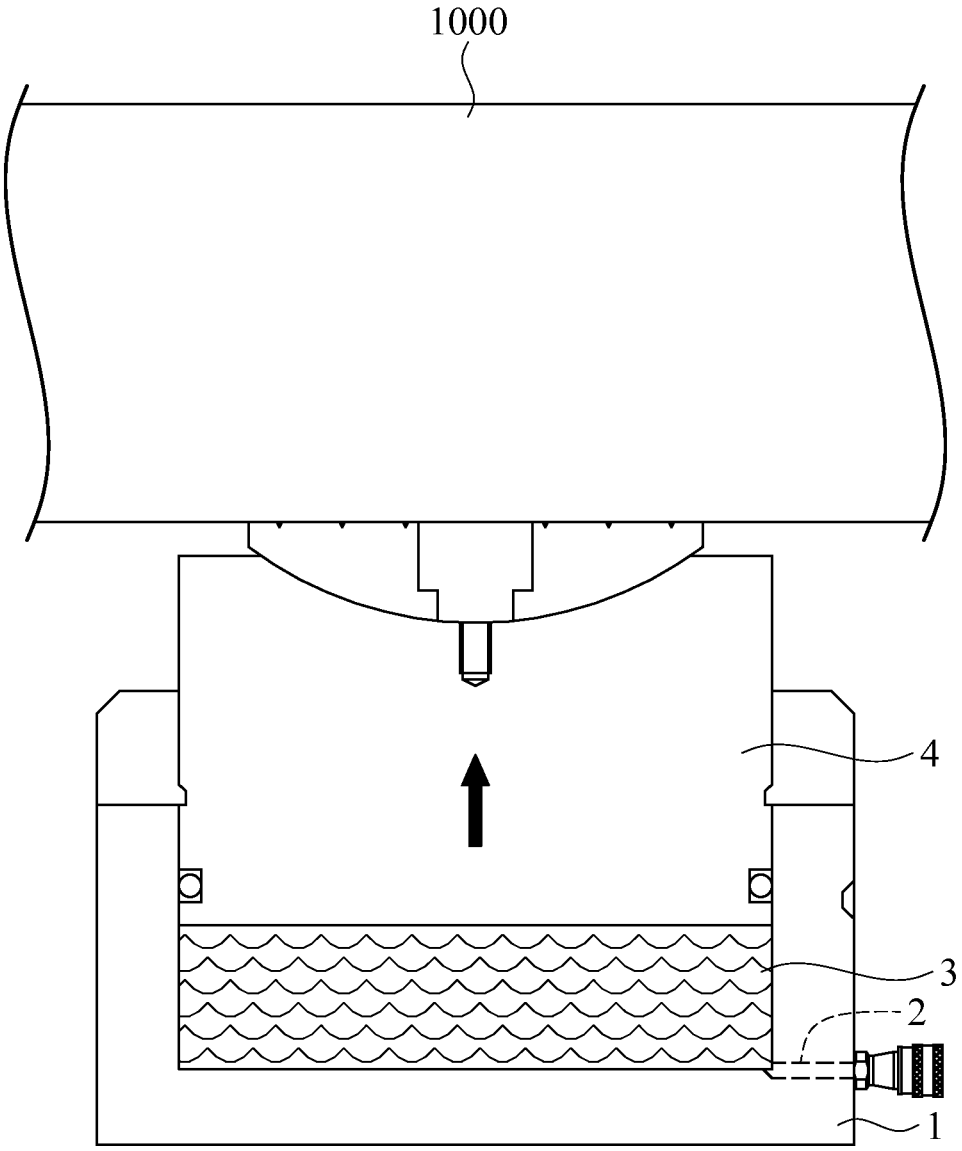
FIG. 2 (PRIOR ART)
Figure 3:
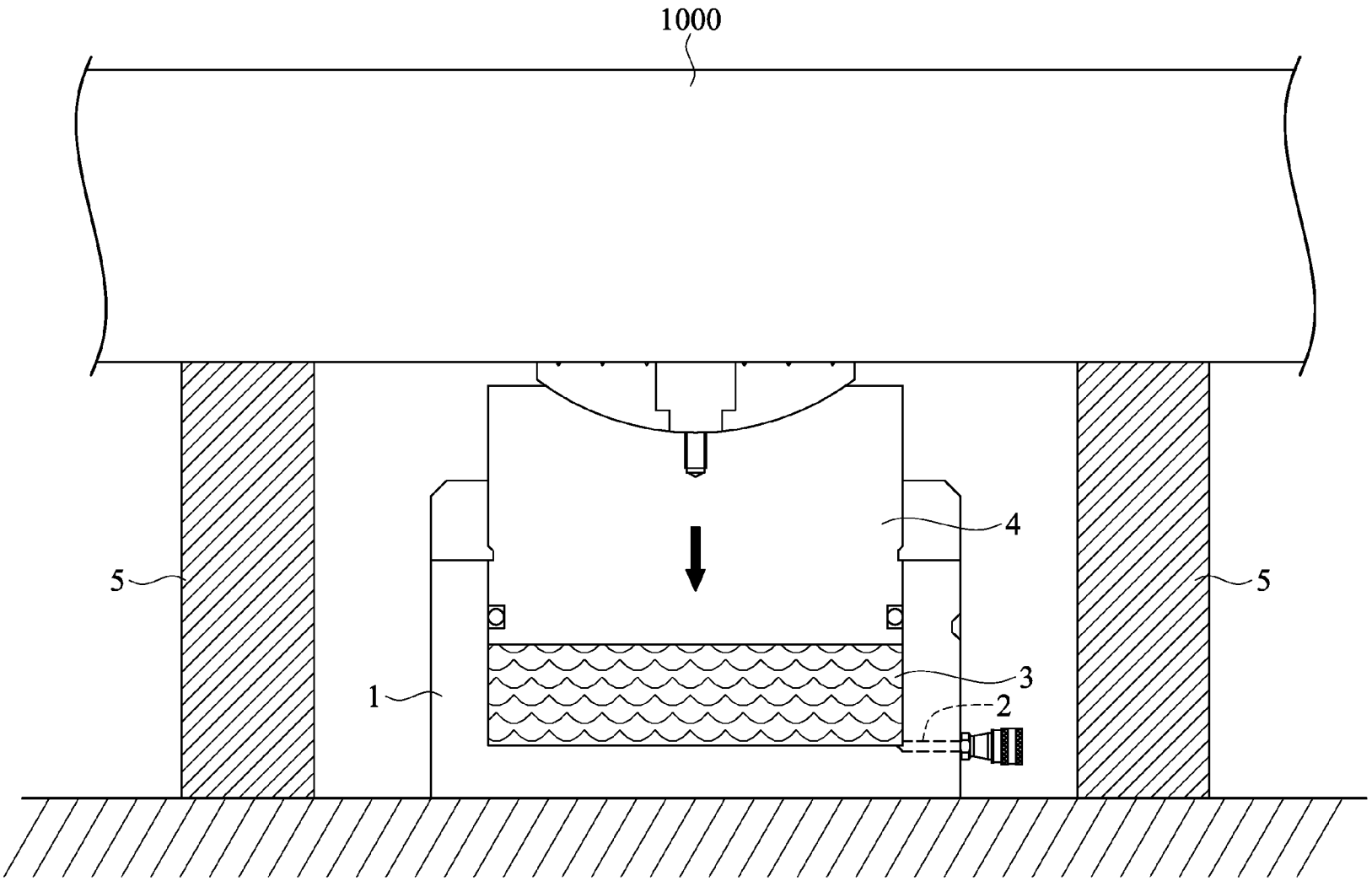
FIG. 3 (PRIOR ART)
Figure 4:
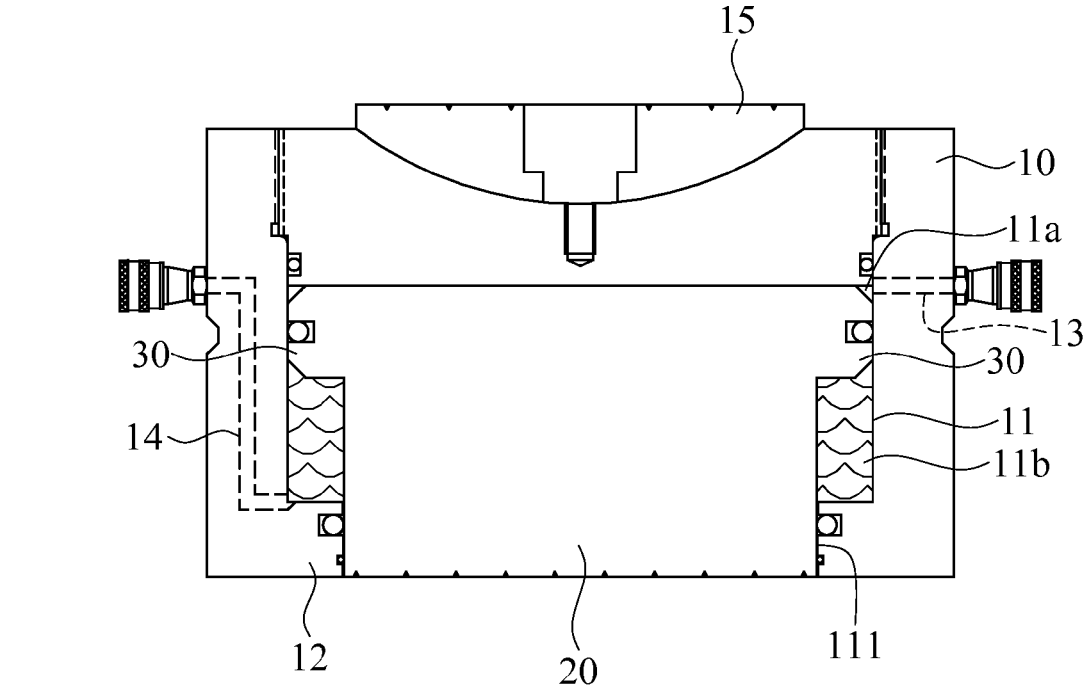
FIG. 4 is a schematic view of a thin jack operating in the first state according to the first embodiment of the present invention.
Figure 5:
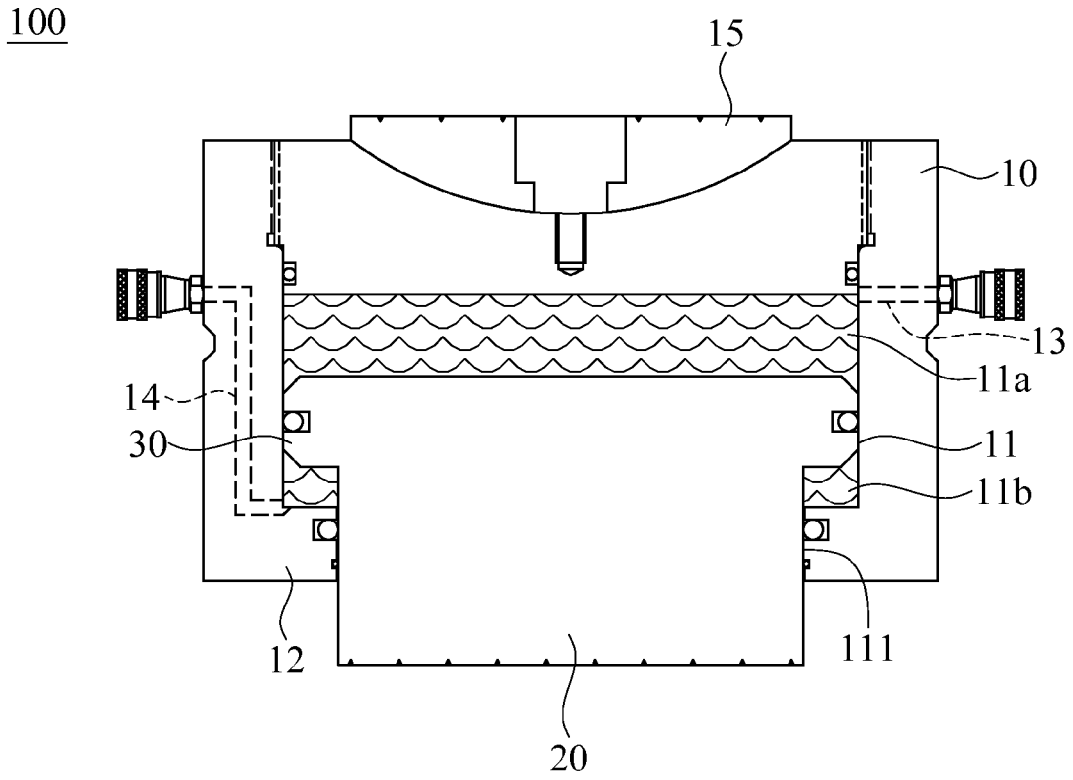
FIG. 5 is a schematic view of the thin jack operating in the second state according to the first embodiment of the present invention.

Referring to FIG. 4 and FIG. 5, there are shown schematic views of a thin jack 100 according to the first embodiment of the present invention. The thin jack 100 comprises a body 10, a piston support post 20, and a dividing piston 30. The thin jack 100 lifts an object 1000 (shown in FIG. 6A through FIG. 6D.)

The body 10 has a receiving chamber 11, a limiting piston 12, an upper passage 13, a lower passage 14, and a jack platform 15. The receiving chamber 11 is concavely disposed in the body 10 and has an opening 111 which opens down. The limiting piston 12 is circumferentially disposed on a sidewall of the receiving chamber 11 and positioned proximate to the opening 111. The upper passage 13 penetrates a sidewall of the body 10 and is in communication with a top portion of the receiving chamber 11. The lower passage 14 penetrates the sidewall of the body 10 and is in communication with a bottom portion of the receiving chamber 11. The jack platform 15 is disposed at a top portion of the body 10. As the body 10 rises, the jack platform 15 lifts the object 1000 thereon. Alternatively, according to the present invention, it is also feasible that the thin jack 100 dispenses with a jack platform, such that the object 1000 is lifted directly by the top portion of the body 10 in the course of elevation of the body 10.

The piston support post 20 is movably received in the receiving chamber 11 of the body 10 in a manner to allow the limiting piston 12 to be in fluidtight sliding contact with a sidewall of the piston support post 20.

The dividing piston 30 is disposed at a top portion of the piston support post 20. The dividing piston 30 is in fluidtight sliding contact with an inner wall of the receiving chamber 11 and corresponds in position to the limiting piston 12, such that the dividing piston 30 is confined to the receiving chamber 11 of the body 10. The dividing piston 30 divides the receiving chamber 11 into an upper receiving space 11*a* and a lower receiving space 11*b*. The upper receiving space 11*a* is in communication with the upper passage 13. The lower receiving space 11*b* is in communication with the lower passage 14.

The ascent of the body 10 of the thin jack 100 requires the following to occur. The users introduces a liquid into the upper receiving space 11*a* through the upper passage 13 of the body 10, using a first hydraulic pump (not shown), to expand the upper receiving space 11*a* gradually and contract the lower receiving space 11*b* gradually, thereby allowing the body 10 to elevate. The descent of the body 10 of the thin jack 100 requires the following to occur. The users introduces a liquid into the lower receiving space 11*b* through the lower passage 14 of the body 10, using a second hydraulic pump (not shown), to expand the lower receiving space 11*b* gradually and contract the upper receiving space 11*a* gradually, thereby allowing the body 10 to lower. The liquid is a conventional one, such as oil or water.

Referring to FIG. 5, the admission of the liquid into the upper receiving space 11*a* is accompanied by the discharge of the liquid from the lower receiving space 11*b* through the lower passage 14, whereas the admission of the liquid into the lower receiving space 11*b* is accompanied by the discharge of the liquid from the upper receiving space 11*a* through the upper passage 13. Accordingly, the body 10 of the thin jack 100 ascends and descends as needed.

Figure 6A:
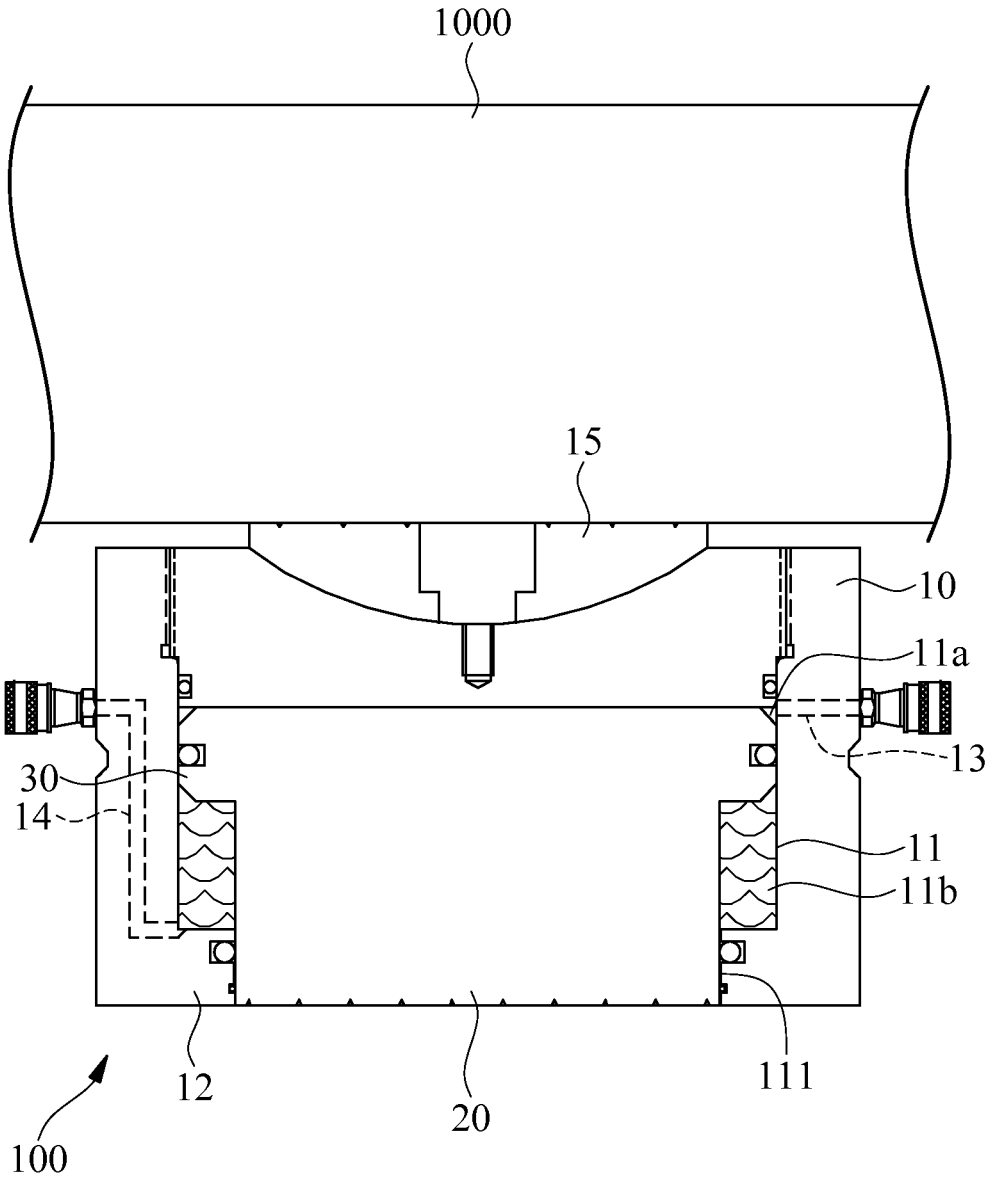
FIG. 6A through FIG. 6D are schematic views of the process flow of the operation of the thin jack according to the first embodiment of the present invention.
Figure 6B:
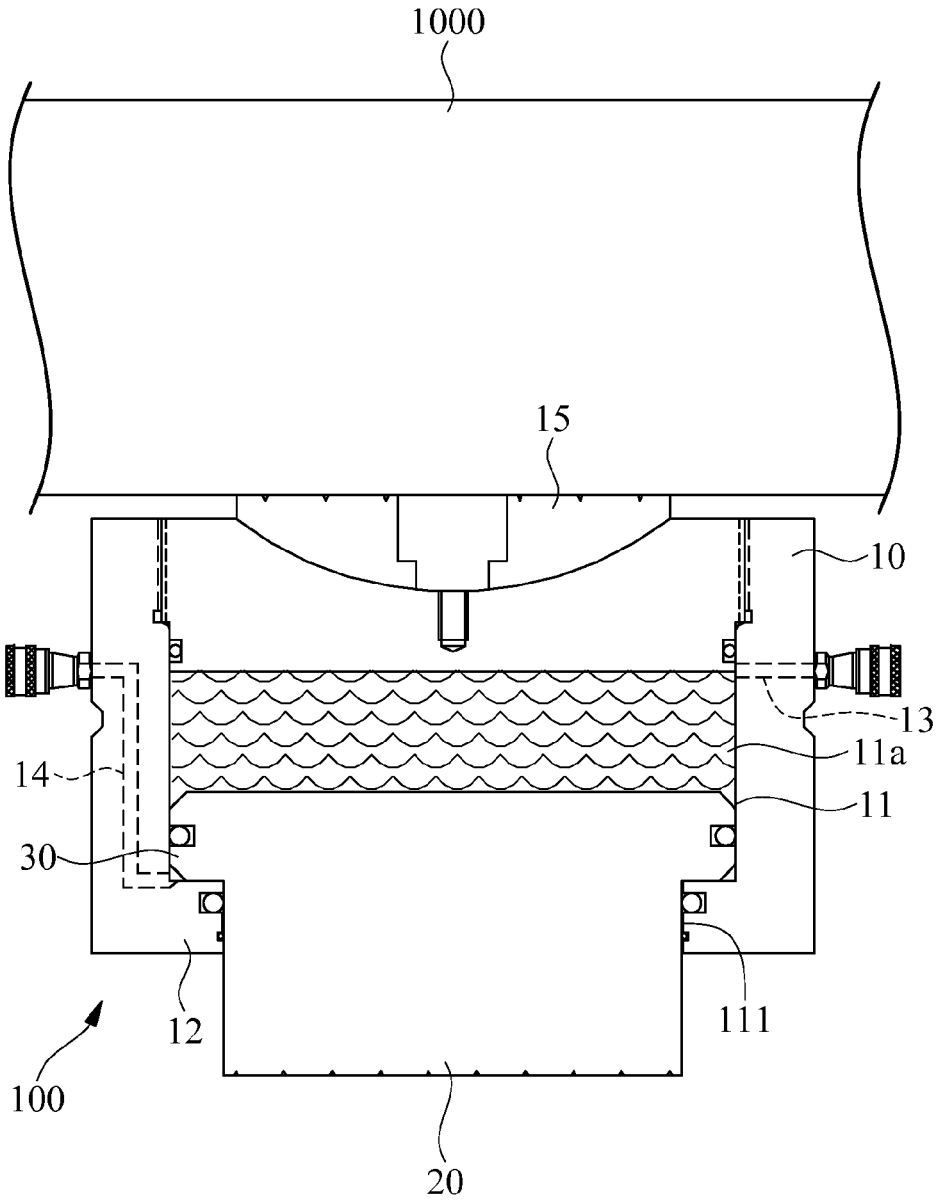
Figure 6C:
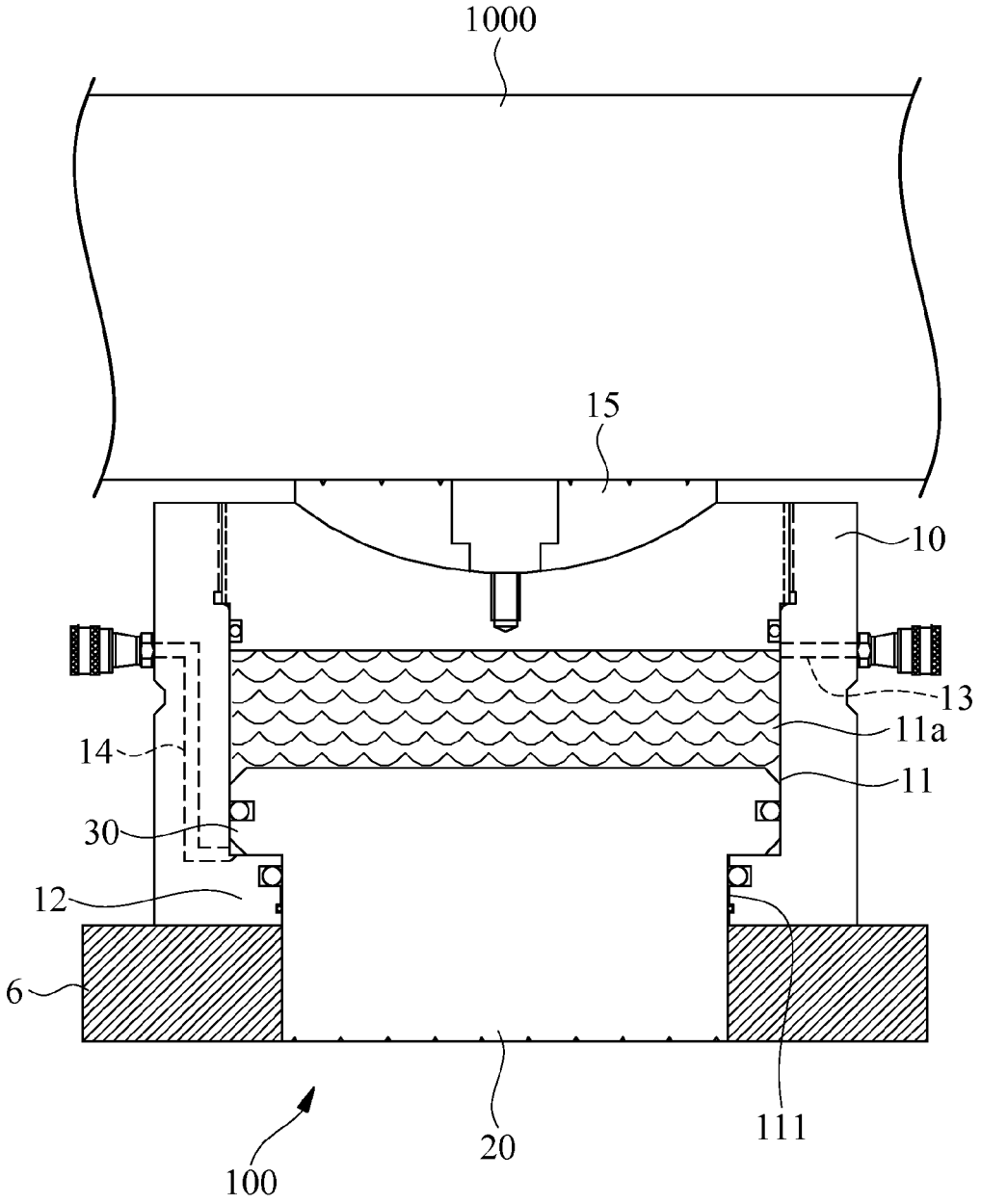
Figure 6D:
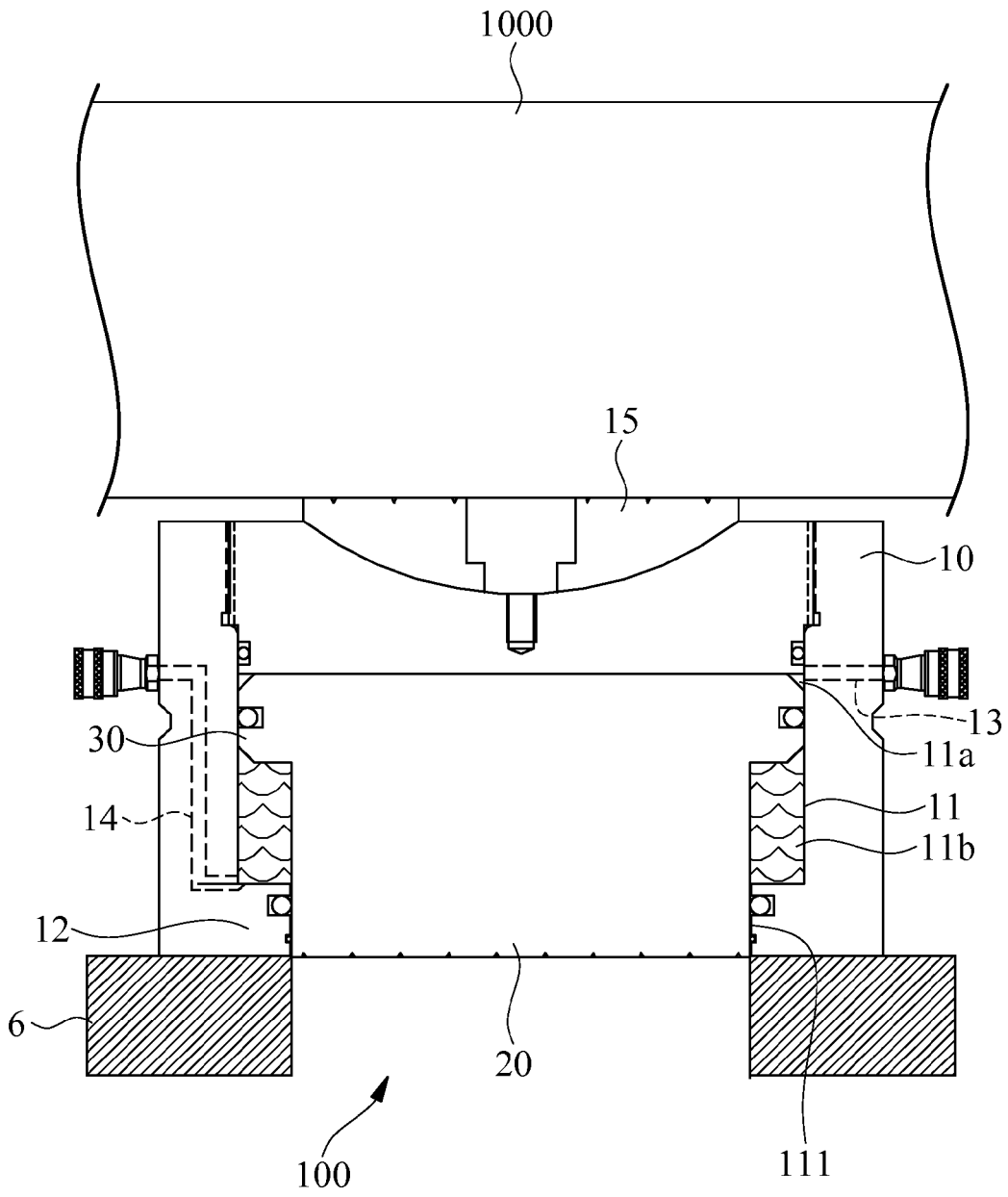
Figure 7:
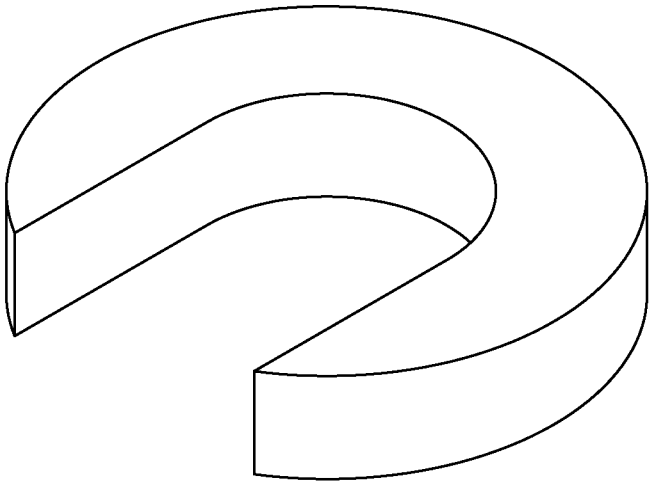
FIG. 7 is a perspective view of a C-shaped underpinning block for use with the thin jack of the present invention.

Referring to FIG. 6A through FIG. 7, there are shown schematic views of the process flow of the operation of the thin jack 100 according to the first embodiment of the present invention. By performing the operations described in the steps illustrated with FIG. 6A through FIG. 7, respectively, users ensure that the piston support post 20 will not support the body 10 through the liquid and thus is less likely to fatigue or even get damaged.

Referring to FIG. 6A, to start lifting the object 1000, the users put the thin jack 100 in a gap between the object 1000 and the ground.

Referring to FIG. 6B, the users introduce the liquid into the upper receiving space 11*a* of the receiving chamber 11 through the upper passage 13, using the first hydraulic pump, such that the body 10 of the thin jack 100 elevates to thereby lift the object 1000 on the jack platform 15 fixed to the top of the body 10.

Referring to FIG. 6C and FIG. 7, the users put a C-shaped underpinning block 6 under the limiting piston 12 of the body 10 in a manner to allow the C-shaped underpinning block 6 to be disposed around the piston support post 20.

Referring to FIG. 6D, the users introduce the liquid into the lower receiving space 11*b* of the receiving chamber 11 through the lower passage 14, using the second hydraulic pump, such that the piston support post 20 retracts into the receiving chamber 11 of the body 10. Hence, the piston support post 20 no longer supports the body 10 through the liquid and thus is less likely to fatigue or even get damaged.

To remove the thin jack 100 from below the object 1000, the users introduce the liquid into the upper receiving space 11*a* of the receiving chamber 11 through the upper passage 13, using the first hydraulic pump, such that the piston support post 20 returns to its position shown in FIG. 6C. Afterward, the users remove the C-shaped underpinning block 6, as shown in FIG. 6B. Finally, the users introduce the liquid into the lower receiving space 11*b* of the receiving chamber 11 through the lower passage 14, using the second hydraulic pump, such that the body 10 of the thin jack 100 ascends as shown in FIG. 6A, and in consequence the users can remove the object 1000 from below the thin jack 100.

In conclusion, the thin jack in the first embodiment of the present invention is conducive to controlling the ascent and descent of the body of the thin jack while lifting the object so as to enable the users to remove the thin jack from below the object.

Figure 8:
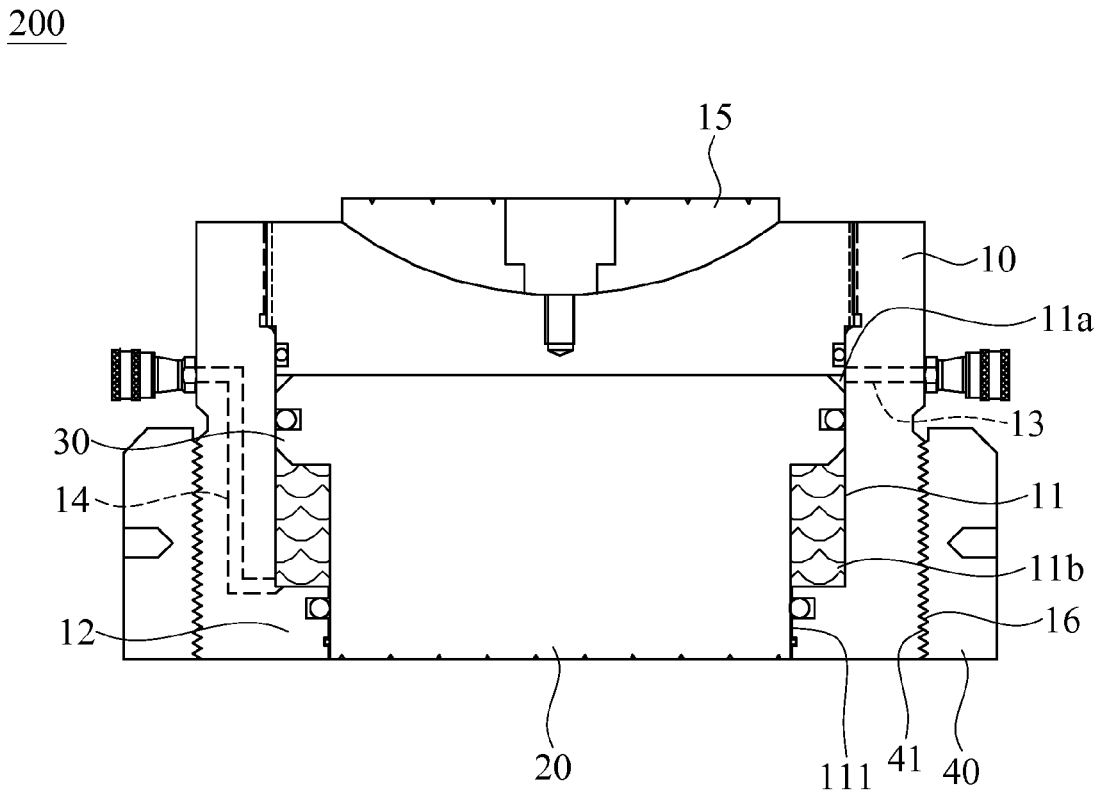
FIG. 8 is a schematic view of the thin jack operating in the first state according to the second embodiment of the present invention.
Figure 9:
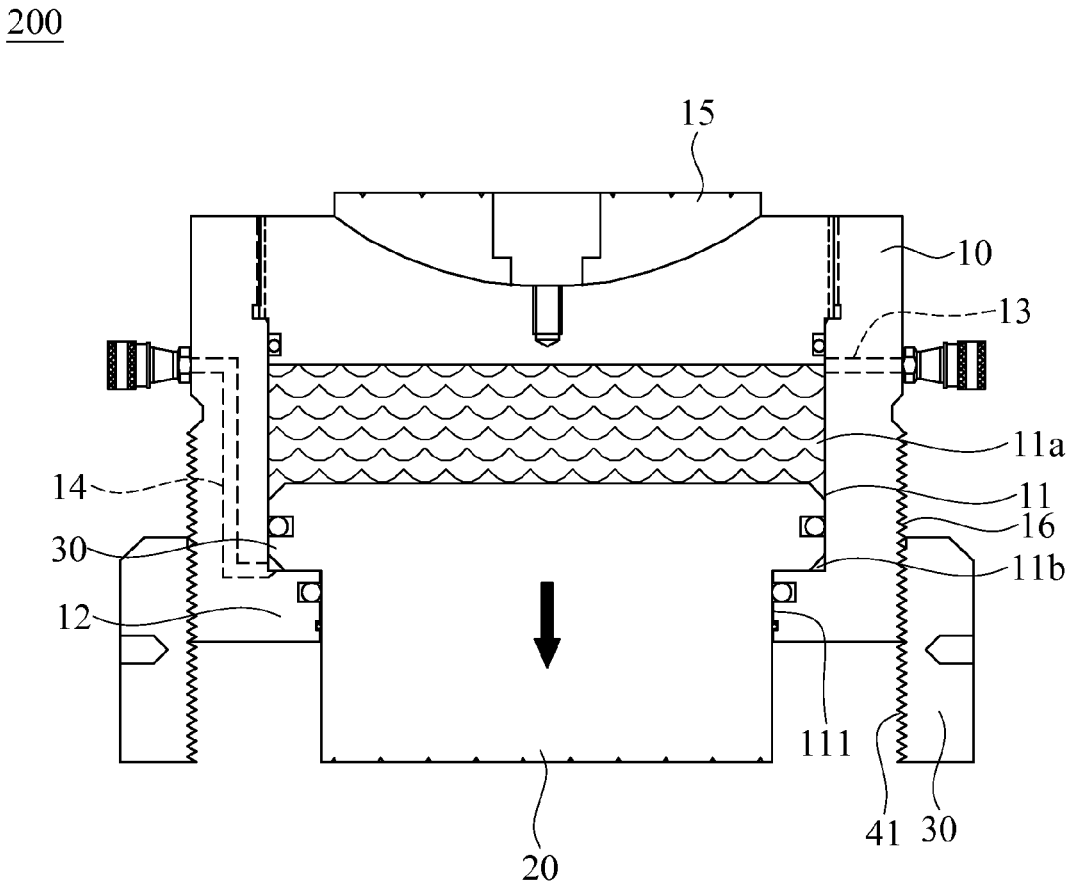
FIG. 9 is a schematic view of the thin jack operating in the second state according to the second embodiment of the present invention.
Figure 10:
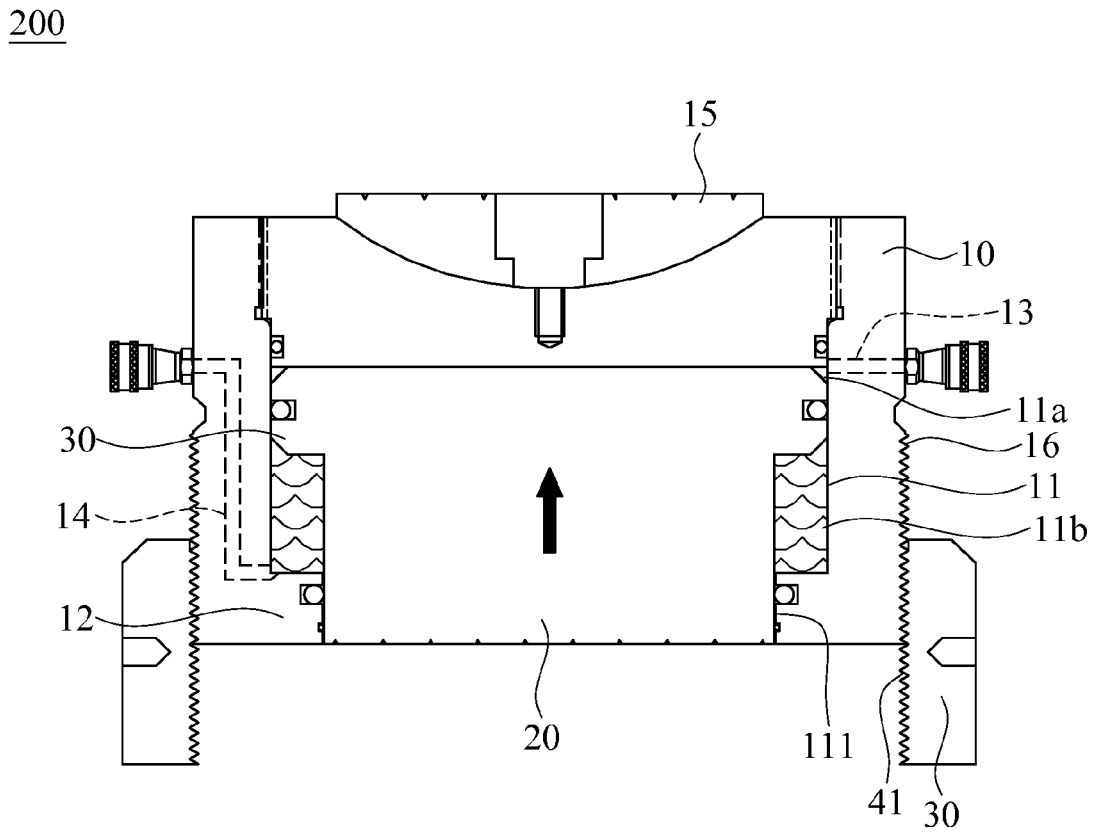
FIG. 10 is a schematic view of the thin jack operating in the third state according to the second embodiment of the present invention.

Referring to FIG. 8 through FIG. 10, there are shown schematic views of a thin jack 200 according to the second embodiment of the present invention. The constituent elements of the thin jack 200 are substantially identical to those of the thin jack 100, except for the differences described below. The thin jack 200 further comprises a supporting annular unit 40 with an internal thread structure 41 disposed on an inner wall of the supporting annular unit 40. The body 10 of the thin jack 200 further has an external thread structure 16 disposed on an outer surface of the sidewall of the body 10. The external thread structure 16 of the body 10 corresponds in position to the internal thread structure 41 of the supporting annular unit 40, such that the supporting annular unit 40 can keep the body 10 of the thin jack 200 at a specified height.

In addition, an outward opening of the upper passage 13 of the body 10 is positioned above the external thread structure 16 preferably, and an outward opening of the lower passage 14 of the body 10 is positioned above the external thread structure 16 preferably, such that the outward openings of the upper passage 13 and the lower passage 14 can never be hidden by the supporting annular unit 40, regardless of the position of the supporting annular unit 40 capable of vertical movement by its own rotation and its internal thread structure 41 which meshes with the external thread structure 16 of the body 10.

To allow the body 10 of the thin jack 200 to elevate, the users introduces a liquid into the upper receiving space 11*a* through the upper passage 13 of the body 10, using the first hydraulic pump, to thereby allow the upper receiving space 11*a* to expand gradually and allow the lower receiving space 11*b* to contract gradually, thereby causing the body 10 elevate. Referring to FIG. 9, the users rotate the supporting annular unit 40 in a direction and thus move the supporting annular unit 40 downward by a distance long enough for the supporting annular unit 40 to support the body 10, thereby keeping the body 10 at a specified height. Referring to FIG. 10, finally, the users introduce the liquid into the lower receiving space 11*b* of the receiving chamber 11 through the lower passage 14, using the second hydraulic pump, so as to cause the piston support post 20 to retract into the receiving chamber 11 of the body 10.

As described above, the purpose of the supporting annular unit 40 is to keep the body 10 of the thin jack 200 at a specified height but dispense with the hassle of putting the C-shaped underpinning block 6 under the limiting piston 12 of the body 10 after the body 10 of the thin jack 200 has elevated and reached the specified height.

Figure 11A:
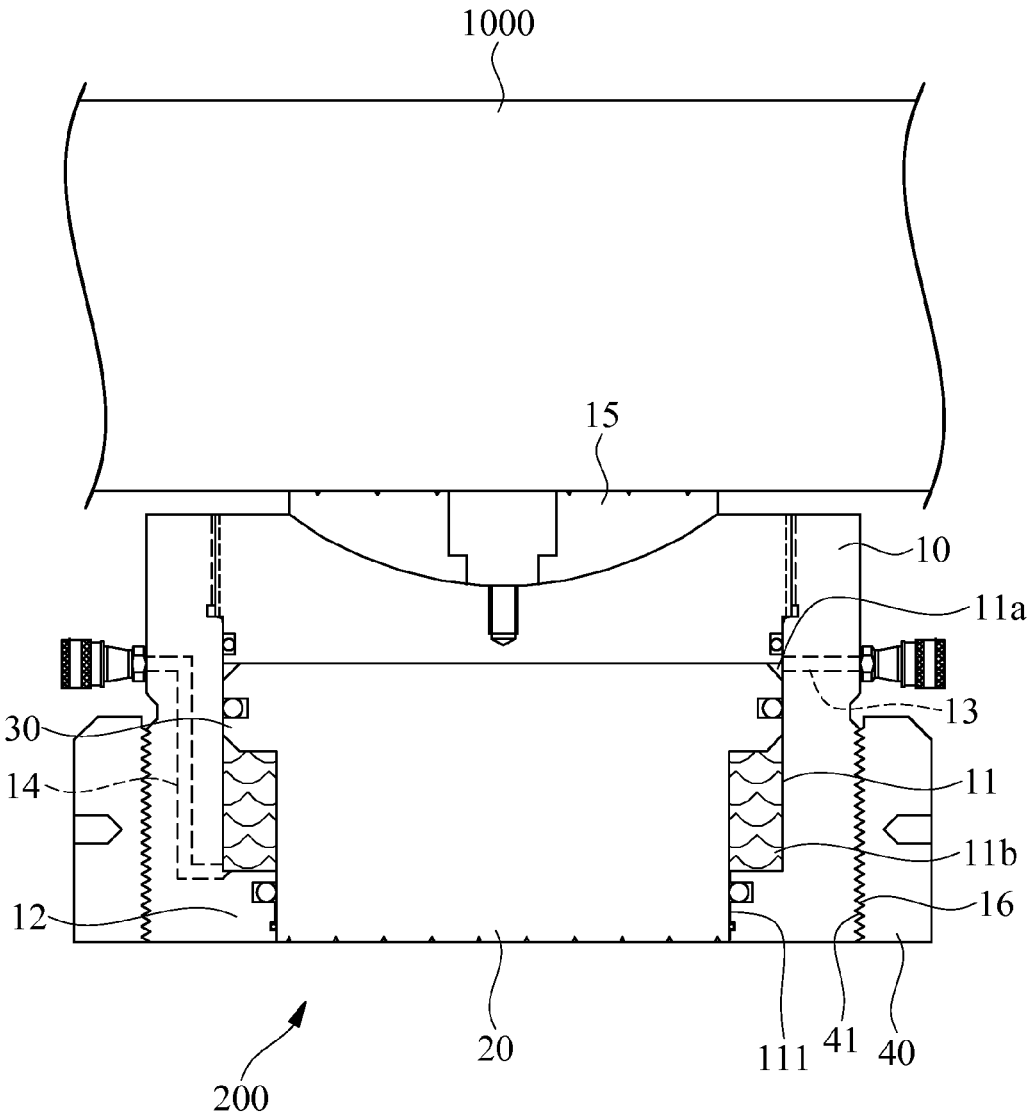
FIG. 11A through FIG. 11I are schematic views of the process flow of the operation of the thin jack according to the second embodiment of the present invention.
Figure 11B:
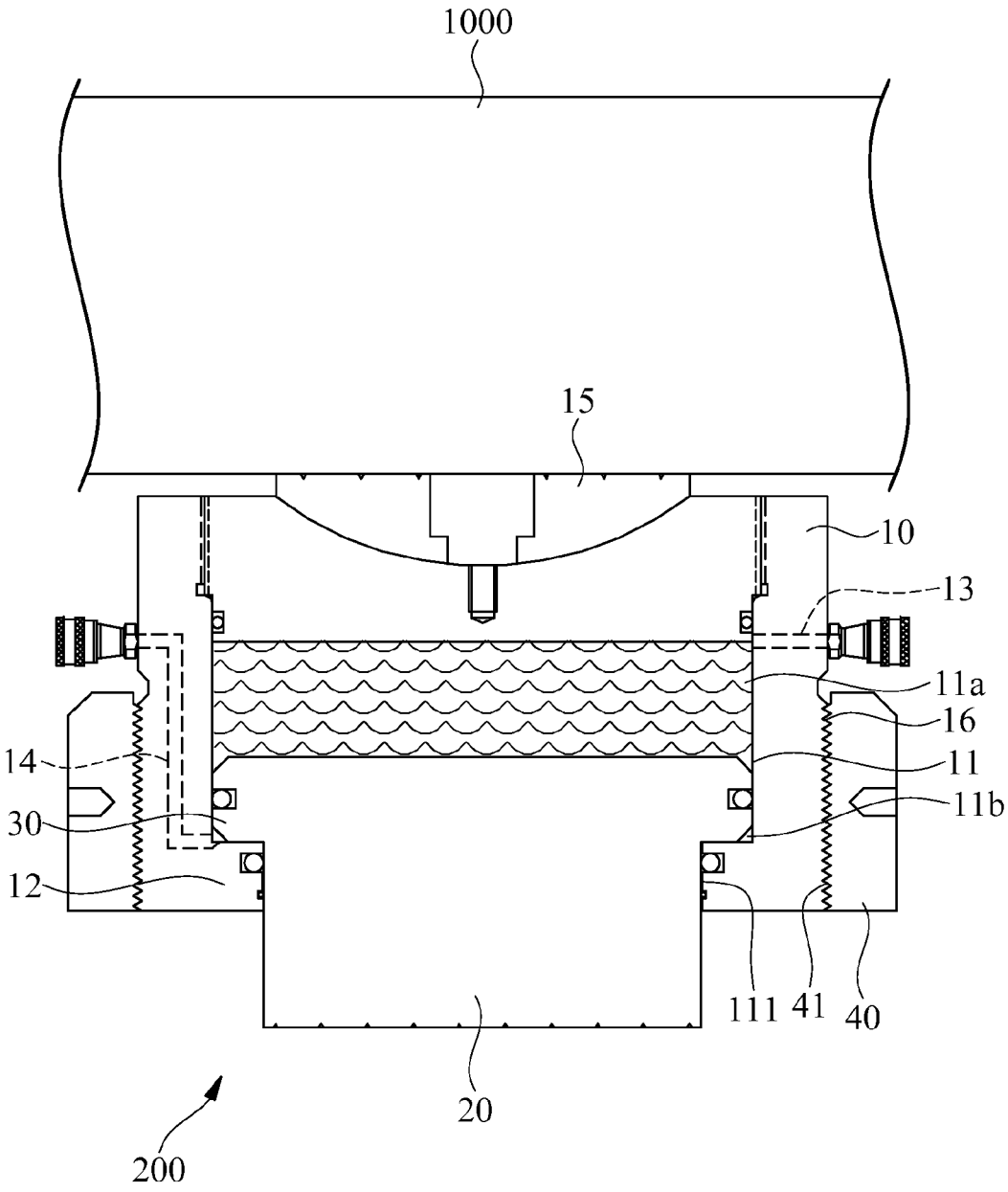
Figure 11C:
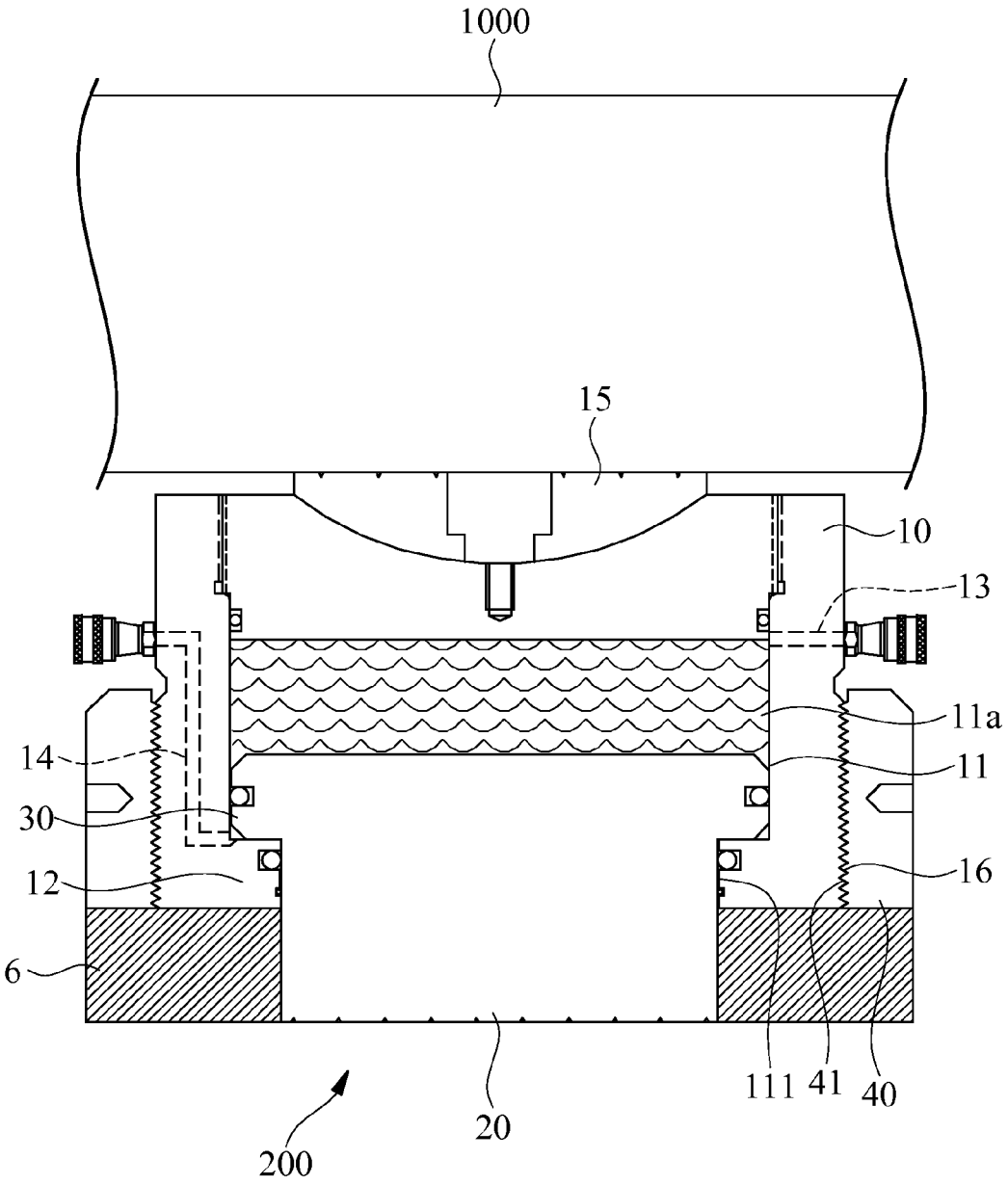
Figure 11D:
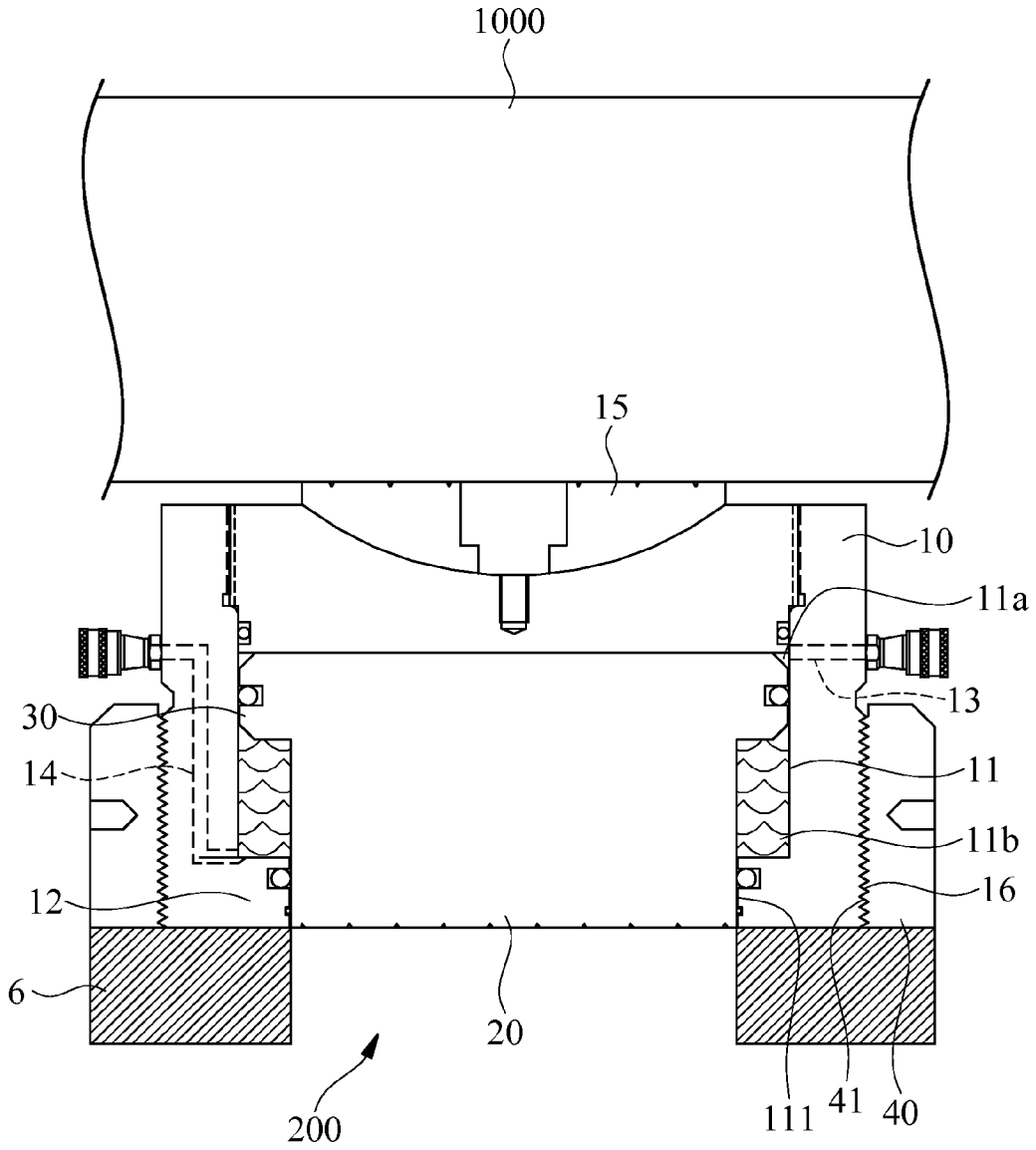
Figure 11E:
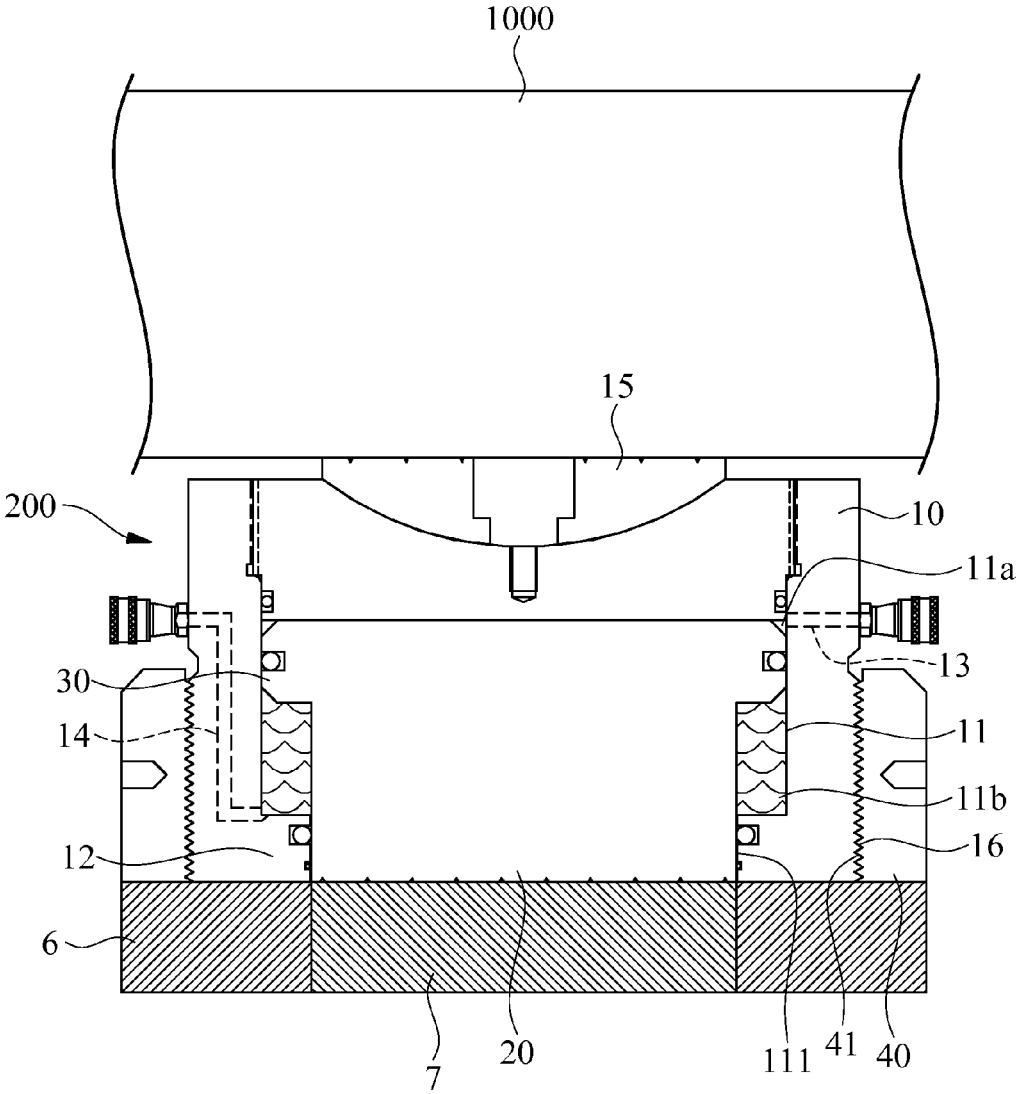
Figure 11F:
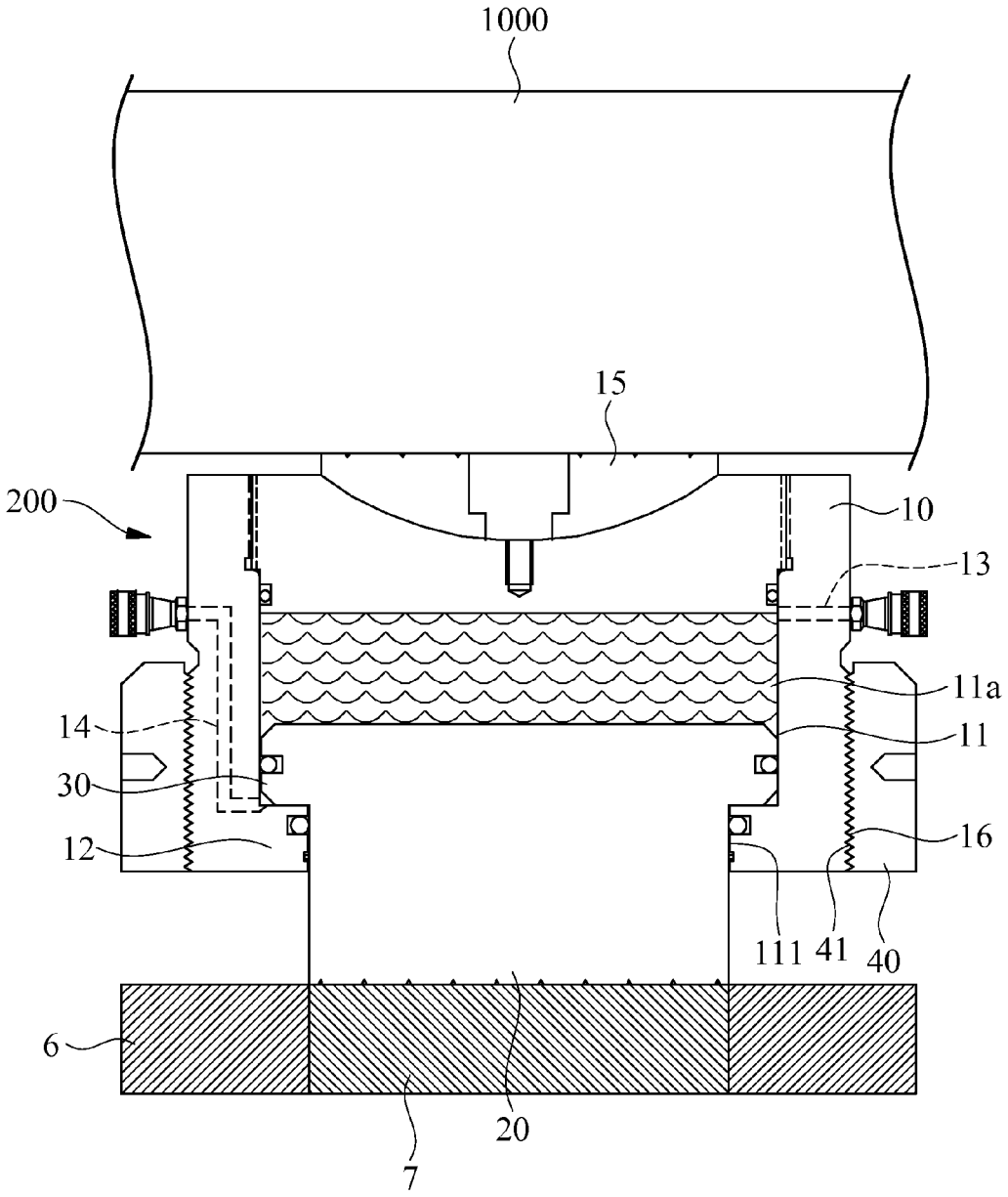
Figure 11G:
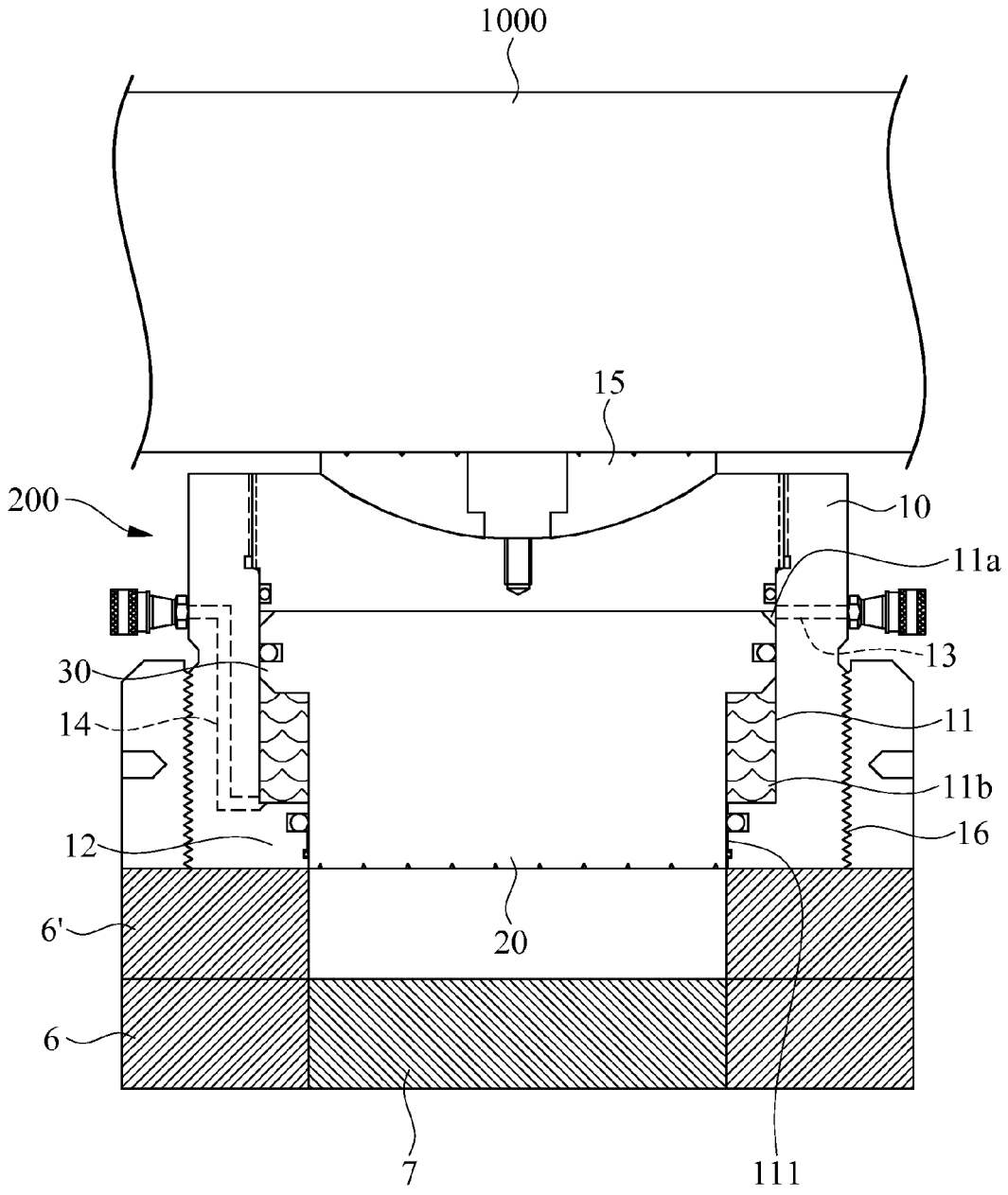
Figure 11H:
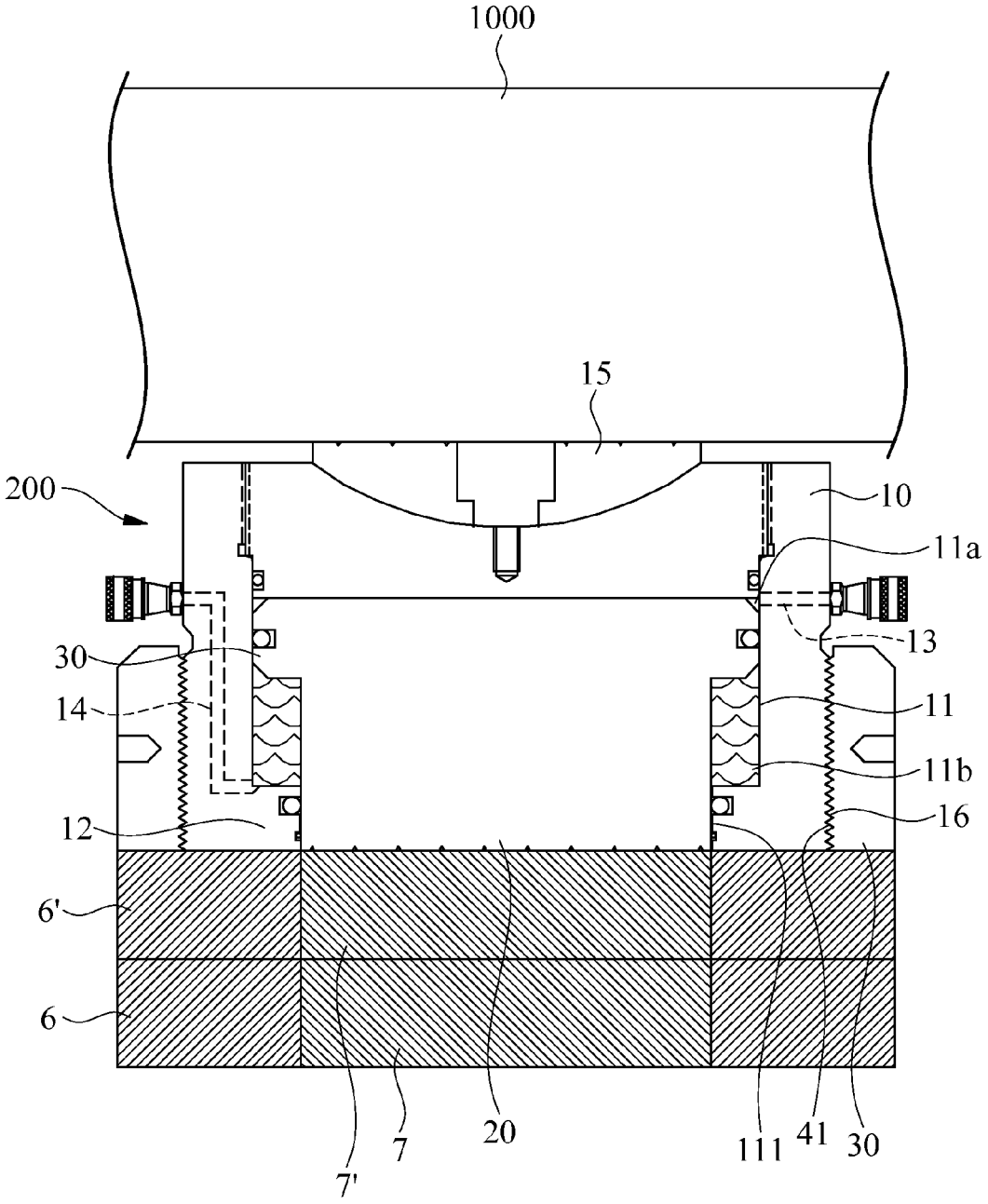
Figure 11I:
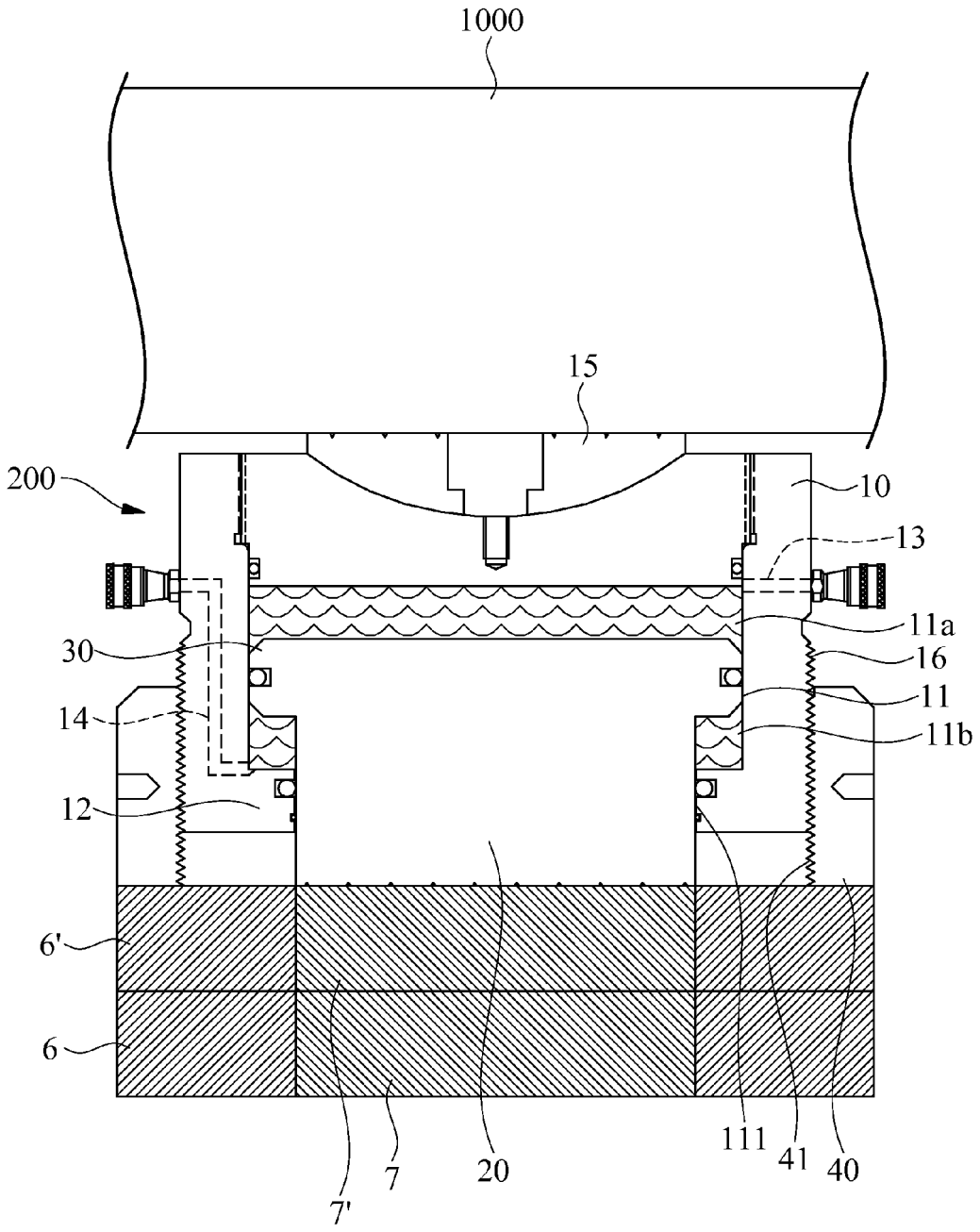
Figure 12:
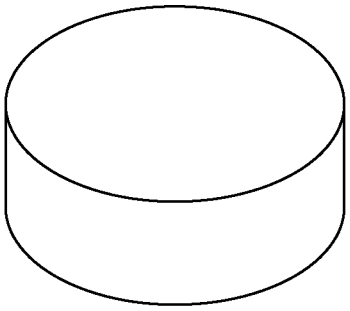
FIG. 12 is a perspective view of a round underpinning block for use with the thin jack of the present invention.

Referring to FIG. 11A through FIG. 12, there are shown schematic views of the process flow of the operation of the thin jack 200. In particular, the diagrams illustrate how to change the height at which the thin jack 200 stays without moving the thin jack 200 horizontally.

Referring to FIG. 11A, the users put the thin jack 200 in a gap (not shown) between the object 1000 and the ground.

Referring to FIG. 11B, the users introduce the liquid into the upper receiving space 11*a* of the receiving chamber 11 through the upper passage 13, using the first hydraulic pump, so as to elevate the body 10 of the thin jack 200.

Referring to FIG. 11C and FIG. 7, the users put the C-shaped underpinning block 6 under the limiting piston 12 of the body 10 in a manner to allow the C-shaped underpinning block 6 to be disposed around the piston support post 20. In doing so, the C-shaped underpinning block 6 keeps the thin jack 100 at a specified height.

Referring to FIG. 11D, to raise the thin jack 200, the users introduce the liquid into the lower receiving space 11*b* of the receiving chamber 11 through the lower passage 14, using the second hydraulic pump, to cause the piston support post 20 to retract into the receiving chamber 11 of the body 10.

Referring to FIG. 11E and FIG. 12, the users put a round underpinning block 7 below the piston support post 20, wherein the C-shaped underpinning block 6 is as thick as the round underpinning block 7. Alternatively, the C-shaped underpinning block 6 is not as thick as the round underpinning block 7.

Referring to FIG. 11F, again, the users introduce the liquid into the upper receiving space 11*a* of the receiving chamber 11 through the upper passage 13, using the first hydraulic pump, so as to elevate the body 10 of the thin jack 200.

Referring to FIG. 11G, the users insertedly put another C-shaped underpinning block 6' between the limiting piston 12 and the C-shaped underpinning block 6, and then introduces the liquid into the lower receiving space 11*b* of the receiving chamber 11 through the lower passage 14, using the second hydraulic pump, thereby causing the piston support post 20 to retract into the receiving chamber 11 of the body 10.

Referring to FIG. 11H, the users insertedly put another round underpinning block 7' between the limiting piston 12 and the round underpinning block 7. The C-shaped underpinning block 6' is as thick as the round underpinning block 7'. Alternatively, the C-shaped underpinning block 6' is not as thick as the round underpinning block 7'.

Referring to FIG. 11I, finally and again, the users introduce the liquid into the upper receiving space 11*a* of the receiving chamber 11 through the upper passage 13, using the first hydraulic pump, to elevate the body 10 of the thin jack 200, and then rotate the supporting annular unit 40 in a direction and thus move the supporting annular unit 40 downward by a distance long enough for the supporting annular unit 40 to support the body 10, thereby keeping the body 10 at a specified height.

By following the steps described above, the users change the height at which the thin jack 200 stays.

To restore the thin jack 200 to its state depicted in FIG. 11A, the users follow the above steps in reverse order as described below. First, the users rotate the supporting annular unit 40 in the opposite direction and thus move the supporting annular unit 40 upward until the supporting annular unit 40 no longer supports the body 10. Then, the users introduce the liquid into the lower receiving space 11*b* of the receiving chamber 11 through the lower passage 14, using the second hydraulic pump, to lower the body 10 of the thin jack 200, as shown in FIG. 11H. Afterward, the users remove the round underpinning block 7' as shown in FIG. 11G. Then, the users introduce the liquid into the upper receiving space 11*a* of the receiving chamber 11 through the upper passage 13, using the first hydraulic pump, such that the piston support post 20 descends until it rests on the round underpinning block 7, and then the users remove the C-shaped underpinning block 6', as shown in FIG. 11F. Then, again, the users introduce the liquid into the lower receiving space 11*b* of the receiving chamber 11 through the lower passage 14, using the second hydraulic pump, thereby lowering the body 10 of the thin jack 200, as shown in FIG. 11E. Then, the users remove the round underpinning block 7, as shown in FIG. 11D. Afterward, again, the users introduce the liquid into the upper receiving space 11*a* of the receiving chamber 11 through the upper passage 13, using the first hydraulic pump, thereby restoring the piston support post 20 to its position shown in FIG. 11C. Then, the users remove the C-shaped underpinning block 6, as shown in FIG. 11B. Eventually and again, the users introduce the liquid into the lower receiving space 11*b* of the receiving chamber 11 through the lower passage 14, using the second hydraulic pump, thereby lowering the body 10 of the thin jack 100, as shown in FIG. 11A.

In conclusion, given the aforesaid constituent elements of a thin jack according to the second embodiment of the present invention, a body of the thin jack is put under control to meet users' needs while an object is being lifted by the thin jack, so that it is easy for the users to remove the thin jack from below the object. In addition, due to the supporting annular unit, the body of the thin jack can be kept at a specified height. Furthermore, the users can keep raising the thin jack without moving the thin jack horizontally, so as for the thin jack to be applied to different situations with their respective height requirements.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A thin jack, comprising:

a body having:

a receiving chamber concavely disposed in the body and having an opening opening down;

a limiting piston circumferentially disposed on a sidewall of the receiving chamber and positioned proximate to the opening;

an upper passage penetrating a sidewall of the body and being in communication with a top portion of the receiving chamber; and a lower passage penetrating the sidewall of the body and being in communication with a bottom portion of the receiving chamber;

a piston support post movably received in the receiving chamber and having a sidewall in fluidtight sliding contact with the limiting piston;

a dividing piston disposed at a top portion of the piston support post, being in fluidtight sliding contact with a sidewall of the receiving chamber, and corresponding in position to the limiting piston to confine the dividing piston to the receiving chamber; and a supporting annular unit with an internal thread structure disposed on an inner wall of the supporting annular unit, and the body further has an external thread structure disposed on an outer surface of a sidewall of the body, the external thread structure corresponding in position to the internal thread structure, such that the body can be fixed in place by the supporting annular unit, wherein the dividing piston divides the receiving chamber into an upper receiving space and a lower receiving space, the upper receiving space being in communication with the upper passage, and the lower receiving space being in communication with the lower passage;

wherein an outward opening of the upper passage of the body is positioned above the external thread structure, and an outward opening of the lower passage of the body is positioned above the external thread structure.

2. The thin jack of claim 1, wherein the body further has a jack platform disposed at a top portion of the body.

* * * * *